US007749377B2

(12) United States Patent
Serban et al.

(10) Patent No.: US 7,749,377 B2
(45) Date of Patent: Jul. 6, 2010

(54) METHODS OF DENITROGENATING DIESEL FUEL

(75) Inventors: Manuela Serban, Glenview, IL (US); Joseph A. Kocal, Glenview, IL (US)

(73) Assignee: UOP LLC, Des Plaines, IL (US)

( * ) Notice: Subject to any disclaimer, the term of this patent is extended or adjusted under 35 U.S.C. 154(b) by 273 days.

(21) Appl. No.: 11/985,144

(22) Filed: Nov. 14, 2007

(65) Prior Publication Data

US 2009/0120841 A1 May 14, 2009

(51) Int. Cl.
*C10G 17/00* (2006.01)

(52) U.S. Cl. ..... 208/254 R; 208/211; 208/265

(58) Field of Classification Search ..... 208/254 R, 208/209, 211

See application file for complete search history.

(56) References Cited

U.S. PATENT DOCUMENTS 7,001,504 B2 2/2006 Schoonover
7,198,712 B2 4/2007 Olivier-Bourbigou et al.
2004/0045874 A1 3/2004 Olivier-Bourbigou et al.
2004/0118748 A1 * 6/2004 Lesemann et al. ..... 208/211
2005/0010076 A1 1/2005 Wasserscheid et al.

OTHER PUBLICATIONS

Jess, Andreas, Green Chem., 2004, 6, 316-322, "Deep desulfurization of oil refinery streams by extraction with ionic liquids".

* cited by examiner

*Primary Examiner*—Walter D Griffin
*Assistant Examiner*—Renee Robinson
(74) *Attorney, Agent, or Firm*—James C Paschall

(57) ABSTRACT

A process for denitrogenating diesel fuel includes contacting diesel fuel containing one or more nitrogen compounds with an acid ionic liquid in an extraction zone to selectively remove the nitrogen compound(s) and produce a denitrogenated diesel fuel effluent containing denitrogenated diesel fuel and acid ionic liquid containing nitrogen species; and separating denitrogenated diesel fuel from the denitrogenated diesel fuel effluent.

19 Claims, 8 Drawing Sheets

METHODS OF DENITROGENATING DIESEL FUEL

TECHNICAL FIELD

This disclosure relates to denitrogenating diesel fuel, particularly to methods of pretreating diesel fuel to remove nitrogen species and subsequently subject the denitrogenated diesel fuel to hydrodesulfurization.

BACKGROUND

Diesel fuel is a popular fuel throughout the world. However, diesel fuel contains sulfur-containing molecules that are well known pollutants. Therefore, there is an ever increasing need to provide diesel fuels that have ultra low sulfur content. A typical way of removing sulfur from diesel fuel is by catalytic hydrodesulfurization (HDS). It is, however, becoming more difficult to catalytically hydrodesulfurize diesel fuels to the lower level of sulfur now required. Thus, it would be advantageous to provide a new means for efficiently and effectively hydrodesulfurizing diesel fuel.

SUMMARY

We provide processes for denitrogenating diesel fuel including contacting diesel fuel containing one or more nitrogen compounds with an acid ionic liquid in an extraction zone to selectively remove the nitrogen compound(s) and produce a denitrogenated diesel fuel effluent containing denitrogenated diesel fuel and acid ionic liquid containing nitrogent species, and separating denitrogenated diesel fuel from the denitrogenated diesel fuel effluent.

We also provide processes for desulfurizing diesel fuel including contacting diesel fuel containing one or more nitrogen compounds with an acid ionic liquid in an extraction zone to selectively remove the nitrogen compound(s) and produce a denitrogenated diesel fuel effluent containing denitrogenated diesel fuel and acid ionic liquid containing nitrogen species; separating the denitrogenated diesel fuel from the denitrogenated diesel fuel effluent, and desulfurizing the denitrogenated diesel fuel by hydrodesulfurization.

We further provide processes for denitrogenating diesel fuel including contacting diesel fuel containing one or more nitrogen compounds with $BMIMHSO_4$, $BMIMCH_3SO_4$, or $EMIMEtSO_4$, containing 0-about 5% water, in at least one extraction zone substantially at ambient temperature and ambient pressure for about 5 to about 60 minutes at a feed weight ratio of diesel fuel/$BMIMHSO_4$, $BMIMCH_3SO_4$, or $EMIMEtSO_4$ of about 1:0.2 to about 1:2 to selectively remove at least about 70% of the nitrogen compound(s) and produce denitrogenated diesel fuel effluent containing denitrogenated diesel fuel and $BMIMHSO_4$, $BMIMCH_3SO_4$, or $EMIMEtSO_4$ containing nitrogen species and 0-about 5% water, separating the denitrogenated diesel fuel from the denitrogenated diesel fuel effluent, removing substantially all of the nitrogen species from the $BMIMHSO_4$, $BMIMCH_3SO_4$, or $EMIMEtSO_4$ containing nitrogen species by steam stripping to produce regenerated $BMIMHSO_4$, $BMIMCH_3SO_4$, or $EMIMEtSO_4$, and recycling at least a portion of the regenerated $BMIMHSO_4$, $BMIMCH_3SO_4$, or $EMIMEtSO_4$ to the extraction zone.

DETAILED DESCRIPTION

Figure 1:
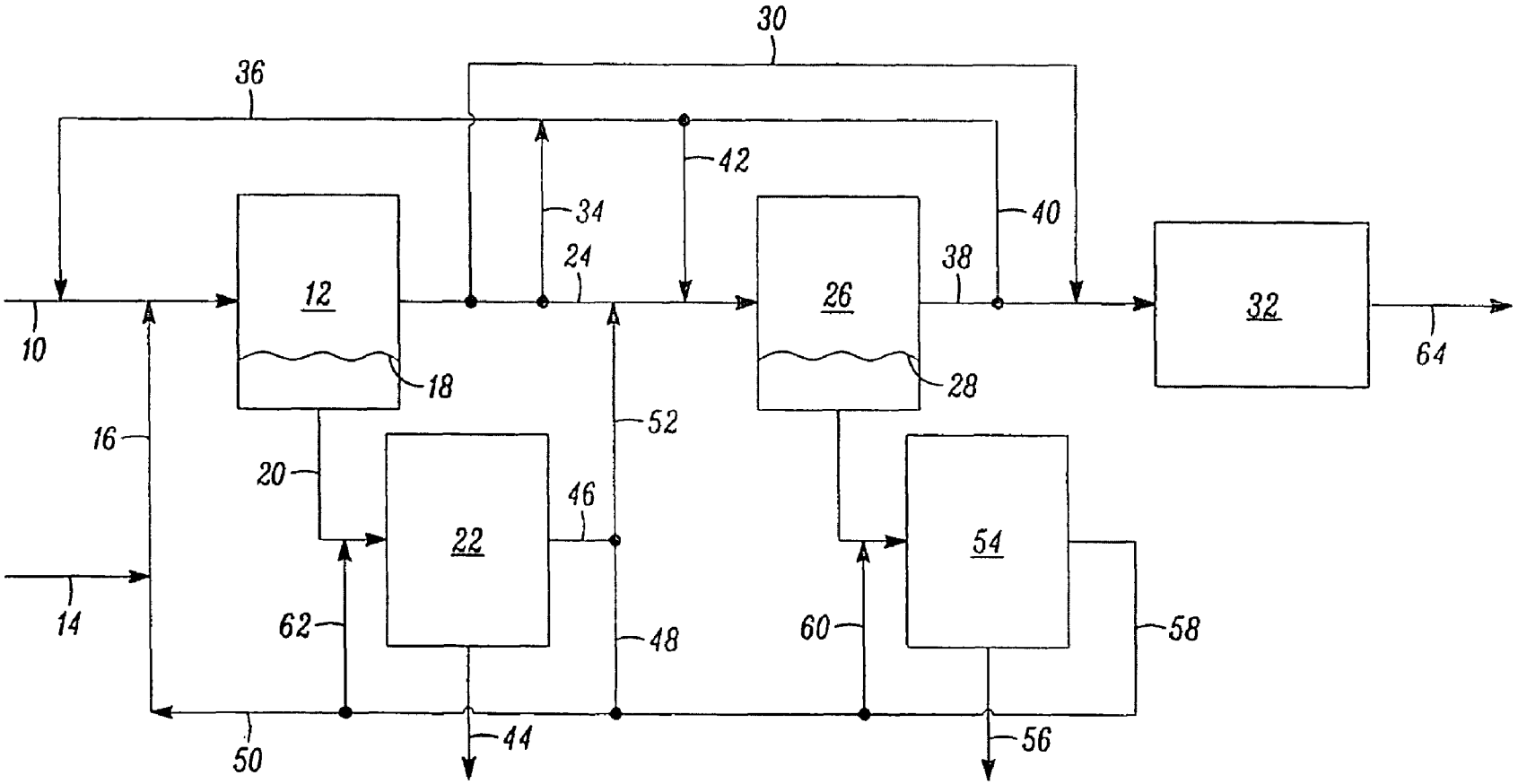
FIG. 1 is a schematic flow diagram of selected aspects of a representative denitrogenating and desulfurizing process.

The terms "diesel," "diesel fuel," "diesel blends," "diesel phase" and similar terms relating to diesel will be used repeatedly in the description below and the appended claims. The term(s) should be interpreted broadly so that they receive not only their ordinary meanings as used by those skilled in the art such as a distillate fuel used in diesel engines, but in a broader manner to account for the broad application of our processes to fuels exhibiting diesel-like characteristics. Thus, the terms include, but are not limited to, straight run diesel, blended diesel, light cycle oil, light coker gas oil, heavy light cycle oils and the like.

We found that catalytic hydrosulfurization (HDS) of the most refractive sulfur containing molecules, i.e., dibenzothiophene (DBT) and especially 4,6 dimethyl-dibenzothiophene (DMDBT) is inhibited to different degrees by the components in the reaction mixture such as organic heterocompounds and polyaromatic hydrocarbons. Nitrogen compounds present in the fuels are the strongest inhibitors in catalytic HDS. In general, the following order of inhibition occurs: saturated and mono-aromatic hydrocarbons<condensed aromatics~oxygen compounds~$H_2S$<organic sulfur compounds<basic nitrogen compounds. We discovered a low temperature and low pressure process for selective, extractive denitrogenation of diesel fuel using acid ionic liquids (AIL). This pretreatment process yields a product low in nitrogen content that is readily upgraded with conventional hydrosulfurization technology to achieve very low sulfur requirements.

Low sulfur requirements can be achieved with conventional catalysts and processes with low nitrogen containing HDS feeds. However, we provide low temperature and low pressure processes for selectively removing the nitrogen compounds from a diesel fuel feed that does not have a low nitrogen content using acid ionic liquids. Ionic liquids are nonaqueous, aprotic solvents, with low melting points, undetectable vapor pressure and good chemical and thermal stability. Since the melting points are low, ionic liquids act as solvents in which reactions can be performed and, because the liquids are made of ions rather than neutral molecules, such reactions/extractions provide distinct reactivities/selectivities when compared to conventional organic solvents. We also define here acid ionic liquids (AIL) as ionic liquids with the pH below 7.

The absence of vapor pressure is another major advantage over organic solvents. Our extracting agents, i.e., acid ionic liquids, have the following properties: the partition coefficient for the N-compounds is high, the extracting agent is insoluble in the HDS feed, the N-free hydrocarbons are not meaningfully soluble in the extracting agent, and regeneration of the agent is relatively easy. Acid ionic liquids generally and, butyl-methyl-imidazolium-hydrogen-sulfate ([BMIM]$HSO_4$), butyl-methyl-imidazolium-methyl-sulfate ([BMIM]$CH_3SO_4$), or ethyl-methyl-imidazolium-hydrogen-ethyl-sulfate ([EMIM]$EtSO_4$) in particular, are particularly effective.

A number of ionic liquids are known. Those ionic liquids can include acid ionic liquids, basic ionic liquids and neutral ionic liquids. We found that the ionic liquids suitable for use in conjunction with denitrogenating diesel fuels are the acid ionic liquids.

More than about 70% total nitrogen and about 90% basic nitrogen may be removed at or around room temperature and atmospheric pressure from various diesels such as diesel blends (Straight Run diesel (SR), Light Cycle Oil (LCO) and Light Coker Gas Oil (LCGO), for example). We found that the nitrogen extraction equilibrium may be reached quickly such as in less than about 5 minutes. Due to large differences in densities, two layers tend to separate rapidly such that the denitrogenated diesel phase can be easily decanted from the acid ionic liquids phase.

Thus, it is possible to denitrogenate diesel fuel by contacting the diesel fuel that contains one or more nitrogen compounds with an acid ionic liquid in an extraction zone to selectively remove the nitrogen compound(s) and produce a denitrogenated diesel fuel effluent containing denitrogenated diesel fuel and acid ionic liquid containing nitrogen species. Then, the denitrogenated diesel fuel is separated from the denitrogenated diesel fuel effluent.

One representative example of apparatus that may be employed in contacting the diesel fuel with acid ionic liquid in an extraction zone is briefly discussed in conjunction with FIG. 1. FIG. 1 also schematically shows aspects of a representative desulfurization process. This system is merely one example of any number of systems that may be used in accordance with our methods. This system is depicted as a continuous system, although batch systems may also be employed. This system relies fundamentally on a feed 10 of diesel fuel that feeds extraction zone 12. Acid ionic liquid 14 flows into extraction zone 12 through line 16. Extraction zone 12 includes a separation portion 18 whereby denitrogenated diesel fuel is separated from acid ionic liquid. Acid ionic liquid exits separator 18 through line 20 and is sent to regeneration zone 22. Denitrogenated diesel fuel is passed through line 24 to a second extraction zone 26 containing a separator 28 in the same manner as previously described. This permits the denitrogenated diesel fuel to be subjected to a second level of denitrogenation if desired. A bypass line 30 permits denitrogenated diesel fuel to pass directly to desulfurization zone 32. Additional bypass lines may be used depending on the number of denitrogenation zones employed.

It is possible for at least a portion of the denitrogenated diesel fuel to be recycled to feed line 10 by way of recycle lines 34 and 36. Separately, at least a portion of denitrogenated diesel fuel passing through line 38 may be recycled through lines 40 and 42 to extraction zone 26 or may continue to be recycled to extraction zone 12.

Acid ionic liquid flowing into regenerator 22 is subjected to steam stripping whereby nitrogen species in the acid ionic liquid are stripped away from the acid ionic liquid and exit regeneration zone 22 through line 44 (together with steam). Regenerated acid ionic liquid passes out of regeneration zone 22 through line 46 and may be recycled to extraction zone 12 by way of lines 48, 50 and 16, may be passed to extraction zone 26 through lines 52 and 24 or may be recycled to regeneration zone 22 by lines 48, 50 and 62.

A second regeneration zone 54 operates in a manner similar to regeneration zone 22. Nitrogen species extracted from the acid ionic liquid (and steam) are removed through line 56. Regenerated acid ionic liquid from extraction zone 54 may be recycled to either of extraction zones 12 or 26. Regenerated acid ionic liquid exiting regeneration zone 54 flows through lines 58, 50 and 16 to be recycled to extraction zone 12. On the other hand, it is possible for regenerated acid ionic liquid to pass through lines 58, 50 and 52 for recycling to extraction zone 26. It is also possible for acid ionic liquid to be subjected to yet another regeneration treatment through lines 58, 50 and 60 or 62 as desired.

FIG. 1 contains two extractions zones and two regenerators as noted above. However, those skilled in the art can employ one extraction and/or regenerator zone as warranted under selected circumstances. On the other hand, additional extraction and/or regeneration zones may be used such as three, four, five, six or more if desired. Also, one or more hydrodesulfurization zones 32 may be employed. Line 64 carries desulfurized diesel fuel for use or further treatment as desired.

The extraction zones 12 and 26 typically operate at or about room temperature and at ambient pressures. It is, of course, possible to vary the temperatures and pressures to some degree to suit ambient operational conditions and the apparatus employed for extraction. For example, the extraction zone can operate at pressures such as ambient to about 1000 psi. Such variations may be made by those skilled in the art. Similarly, regeneration zones 22 and 54 are operated under typical steam stripping conditions known to those skilled in the art. One example is about 150° C. Variations in steam stripping operating conditions and apparatus are also possible. Hydrodesulfurization zone 32 is operated in accordance with known hydrodesulfurization parameters. Finally, the rates of flow of various of the materials through the extraction and/or regeneration zones may be varied to meet the individual characteristics of particular systems, depending on the number of extraction zones and/or regeneration zones, additional treatment apparatus that are present and other operational variables known in the art.

EXAMPLES

A number of Examples are set forth below wherein multiple types of diesel fuel were subjected to denitrogenation under various circumstances and with various acid ionic liquids, as well as other liquids for comparison purposes.

Example 1

A model HDS feed comprised 70% Normal Paraffin C15, 15% Tetraline, 10% Napthalene, 5% 2-Methyl Naphthalene, 722 ppm Quinoline, 290 ppm Carbazole (for a total 100 ppm N), 2500 ppm DBT and 1000 pm DMDBT (for a total 600 ppm S) was prepared. The total S and N amounts in the HDS feed, based on XRF and N chemiluminescent analysis are given in Table 1, Row 1 below. [BMIM]$HSO_4$ was manufactured at UOP (Source nr. UOP-31071-8). The AIL had a melting point of 28° C., decomposition temperature ~300° C., and was completely miscible with $H_2O$.

Approximately 5 grams of HDS or diesel feed were weighted in glass vials and mixed with [BMIM]$HSO_4$ for a weight ratio HDS (diesel) feed: AIL=1:1. The two vials were placed in a digital magnetic stirrer and mixed at room temperature for 30 minutes. Two very distinct layers separated rapidly. The bottom phase, the AIL+the extracted N-compounds was separated from the top HDS or diesel feed layer using a separation funnel.

To assess the extraction capability of the AIL, we performed comparative experiments with a standard organic solvent, i.e., N-methyl pyrrlidone (NMP) with MP=24° C., BP=202° C., ρ=1.028 g/cm$^3$, VP=0.29 mm Hg at 20° C.

The XRF S analysis of the HDS phase after extraction indicated that the NMP (Table 1, Row 3) removed 81.3% S in one extraction step. However, based on the N chemiluminescent analysis it cross-contaminated the HDS feed with 4% NMP. On the other hand, the [BMIM]$HSO_4$ AIL (Table 1, Row 2) removed 95.4% of N in one extraction step. Both carbazole and basic quinoline were removed simultaneously. The amounts of quinoline and carbazole left after extraction corresponded to 5 ppm N. This gave a very good correlation between the GC and the N chemiluminescent analysis, i.e., 4.8 ppm N. Importantly, the extraction step did not affect the aromatic hydrocarbon content suggesting that the hydrocarbons are not soluble in the extracting agent. Also, the low temperature (i.e., ambient) of this process suppresses dissociation, disproportionation and degradation reactions such that the fuel components remain structurally unmodified.

TABLE 1

| | | HDS | | | GC Analysis | | | | |
|---|---|---|---|---|---|---|---|---|---|
| | | Feed:IL (wt ratio) | XRF S ppm | N ppm | Quinoline ppm | Carbazole ppm | Tetralin (%) | Naphtha (%) | 2-M Naphtha (%) |
| Control Example | HDS Feed | — | 783 | 104 | 722 | 290 | 15 | 9.59 | 5.13 |
| | HDS Feed after extraction with [BMIM]$HSO_4$ | 1:1 | 834 | 4.8 | 40 | 16 | 14.2 | 9.51 | 4.7 |
| Comparative Example | HDS Feed after extraction with NMP | 1:1 | 146 | 5687 | NA | NA | NA | NA | NA |

Table 2 summarizes the results of extraction experiments performed with [BMIM]$HSO_4$ and NMP on diesel feed. As in the case of the HDS feed, a substantial amount of NMP (9%) dissolved into the diesel, as calculated by the N amount present in the diesel phase after extraction.

TABLE 2

| | | Diesel:IL (wt) | XRF S ppm | N ppm |
|---|---|---|---|---|
| Control Example | Diesel | — | 13500 | 153 |
| | Diesel after extraction with [BMIM][$HSO_4$] | 0.9:1 | 13000 | 42 |
| Comparative Example | Diesel after extraction with NMP | 0.9:1 | 7776 | 13000 |

Example 2

Another set of experiments was conducted with a model diesel feed. The experiments were conducted at 25° C. for 30 minutes. The feed was as set forth below:

Feed: 70% NormPar C15+15% Tetraline+10% Naphtha+5% 2-M Naphtha+737 ppm Quinoline+239 ppm Carbazole+2537 ppm DBT+1044 ppm DMDBT (104 ppm N+783 ppm S)

The results of the experiment are set forth in Table 3.

TABLE 3

| | Ionic Liquids and NMP | model feed:IL (wt ratio) | XRF S ppm | % S Removal | N ppm* | % N Removal |
|---|---|---|---|---|---|---|
| | Model Feed | — | 783 | — | 104 | — |
| Example | [EMIM]$EtSO_4$ | 0.9:1 | 669 | 14.6 | 50 | 52 |
| Comparative Example | [BMIM]$OcSO_4$ | 1:1 | 490 | 37.4 | 79 | 24 |
| Comparative Example | AMMOENG ™ 100 | 0.9:1 | 450 | 42.5 | 201 | Cross-cont. |
| Example | [BMIM][$HSO_4$] | 1:1 | 750 | 4.2 | 4.8 | 95.4 |
| Comparative Example | NMP | 1:1 | 146 | 81 | 5687 | NMP soluble in the feed |

NMP removed 81% S in one extraction step but cross-contaminated the model feed ⇒ ~4% NMP dissolved in the model feed AMMOENG ™ 100 (quaternary ammonium salt) removed 42.5% S, but cross-contaminated the feed

[BMIM][$HSO_4$] removed 95.4% N

*N analyzed via chemiluminescence analysis (combustion method)

A portion of the experiment included a GC analysis of the feed after extraction which demonstrates that the acidic ionic liquid targets both basic (Quinoline) and non-basic (Carbazole) nitrogen compounds. These results are shown in Table 4.

TABLE 4

| | GC Analysis | |
|---|---|---|
| | Quinoline (ppm) | Carbazole |
| Model Feed | 737 | 239 |
| Model feed after extraction | 40 | 16 |
| wt. [BMIM]$HSO_4$ | 4.3 nitrogen | 1.3 nitrogen |
| | 5.6 ppm total N | |

Example 3

Another set of experiments was performed utilizing straight run diesel. These experiments were run for 30 minutes at 25° C. with a diesel:AIL weight ratio of 1:1.

TABLE 5

| | Ionic Liquid | XRF S ppm | % S Removal | N ppm | % n Removal |
|---|---|---|---|---|---|
| | Diesel Feed | 13500 | — | 153 | — |
| Comparative Example | [BMIM]$OcSO_4$ | 13000 | 3.7 | 137 | 10.5 |
| Comparative Example | AMMOENG ™ 100 | 12900 | 4.4 | 252 | Cross-contamination |
| Example | [BMIM][$HSO_4$] | 13000 | 3.7 | 42 | 73 |
| Comparative Example | NMP | 7776 | 42.5 | 13000 | 9.1% soluble in diesel |

Figure 2:
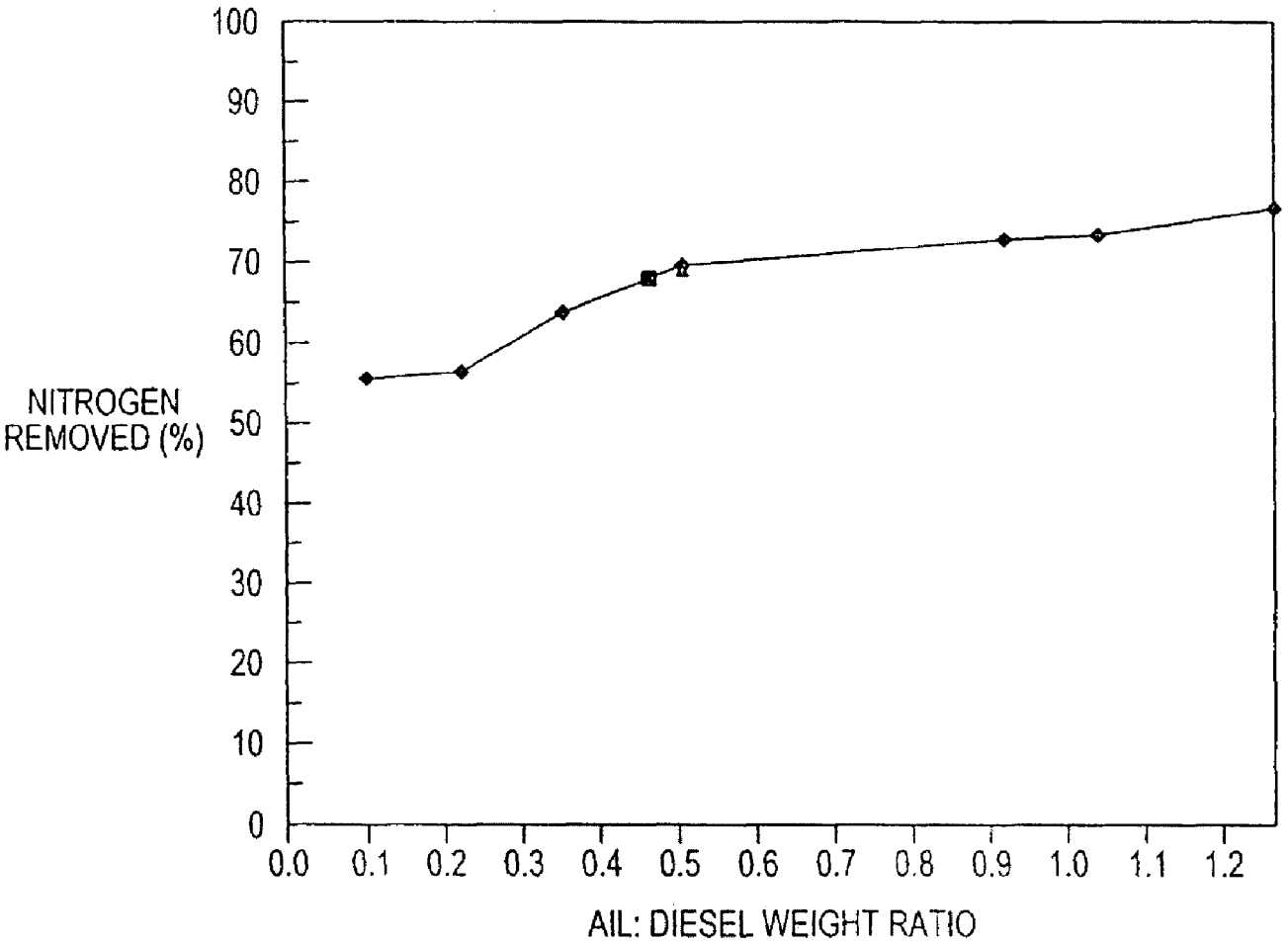
FIG. 2 is a graph of the percentage of nitrogen removal versus AIL:diesel weight ratio.

This test was conducted with respect to BMIM$HSO_4$ at multiple weight ratios with the diesel feed. FIG. 2 shows the percentage of nitrogen removed at the various diesel weight ratios, with a minimum removal rate of at least 55% with a minimal amount of acid ionic liquid feed.

Figure 3:
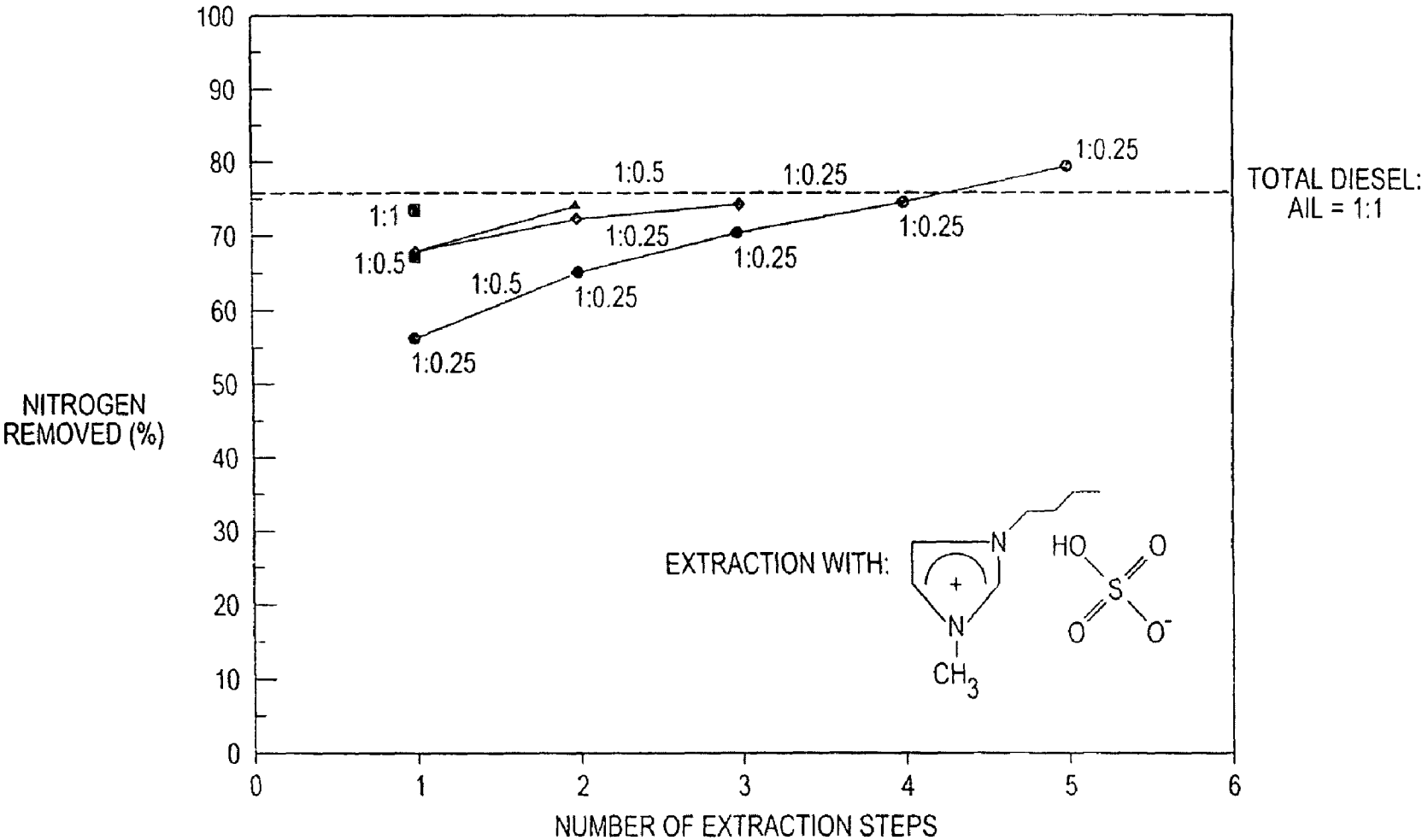
FIG. 3 is a graph of the percentage of nitrogen removed versus the number of extraction steps.

The Example was further conducted multiple times with respect to multiple extractions. The results are shown in FIG. 3. FIG. 3 indicates that single or staged extraction for a weight ratio of diesel:AIL of 1:1 results in a 73% nitrogen removal. This is independent of the number of extraction steps. It can also be seen from FIG. 3 that an additional 5% of nitrogen was removed when the feed of acid ionic liquid was increased to 1.25.

Figure 4:
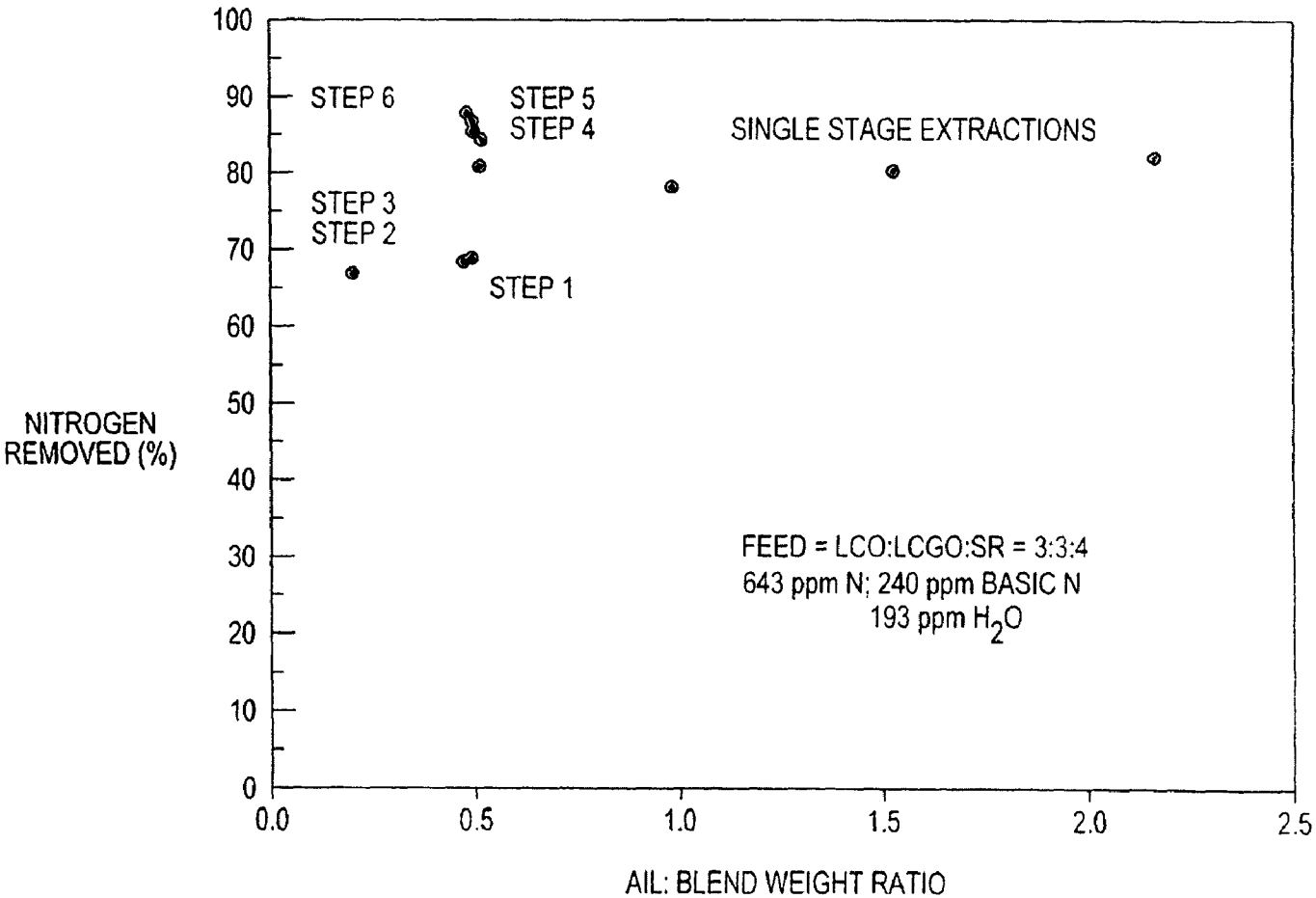
FIG. 4 is a graph of the percentage of nitrogen removed versus the AIL:blend weight ratio.

The experiment also compared single versus staged extraction with BMIM$HSO_4$. The results are shown in FIG. 4. In the single extraction, a diesel blend to AIL weight ratio of 1:0.2 to 1:2.2 was employed. On the other hand, in the staged extraction, six steps were used with a diesel blend:AIL weight ratio of 1:0.5 for a total weight ratio of 1:3. It can be seen from FIG. 4 that BMIM$HSO_4$ removed 70-85% of nitrogen depending on the weight ratios. It can also be seen that the staged extraction produces results that are substantially similar to the single extraction.

Example 4

Another set of experiments was conducted utilizing Light Cycle Oil (LCO) with 1.78% S and 673 ppm N (as carbazole, $C_1$-$C_{6+}$ substituted carbazoles and $C_1$-$C_{6+}$ indoles). The experiments were carried out at atmospheric pressure at a temperature of about 25° C. for a mixing time of 30 minutes. The weight ratio of acidic ionic liquid to LCO was 0.5:1. The results are shown in Table 6 below.

TABLE 6

| | Ionic Liquid | XRF S % | % S Removal | N ppm | % N Removal |
|---|---|---|---|---|---|
| | LCO | 1.78 | — | 673 | — |
| Example | [BMIM]$HSO_4$ | 1.6 | 10 | 300 | 55.4 |
| Comparative Example | [BMIM]$OcSO_4$ | 1.51 | 15.2 | 363 | 46.1 |
| Example | [BMIM]$CH_3SO_4$ | 1.58 | 11.2 | 30 | 95.5 |
| Comparative Example | NMP | Miscible wt. LCO | | | |
| Comparative Example | Furfural | Miscible wt. LCO | | | |

It can be seen from Table 6 that the Comparative Examples were either miscible with the LCO feed material, thereby rendering them impractical, or had a nitrogen removal rate of less than 50%. On the other hand, BMIM$HSO_4$ and BMIM$CH_3SO_4$ removed nitrogen at a significant rate of 55.4 and 95.5%. Also, both of the acid ionic liquids did not remove a substantial quantity of the sulfur.

Example 5

Another set of experiments was conducted utilizing a heavy light cycle oil under the following conditions:

Feed: Heavy LCO; API ~9; 80% aromatics; 5865 ppm S; 1716 ppm N

Experiments: T=25° C.; atm. pressure; mixing time=30 min (equilibrium reached after ~5 min)

The weight ratios of acid ionic liquid to diesel feed were varied as indicated in Table 7.

TABLE 7

| AIL:LCO wt ratio | Nitrogen, ppm | % N removed | Basic N, ppm | % Basic N removed | Sulfur, ppm |
|---|---|---|---|---|---|
| | 1716 (in LCO) | xxx | 50 (in LCO) | xxx | 5865 (in LCO) |
| 2 | 336 | 80.4 | <20 | >60 | |
| 1 | 543 | 68.4 | | | 5849 |
| 0.5 | 834 | 51.4 | <20 | >60 | 5885 |

Figure 5:
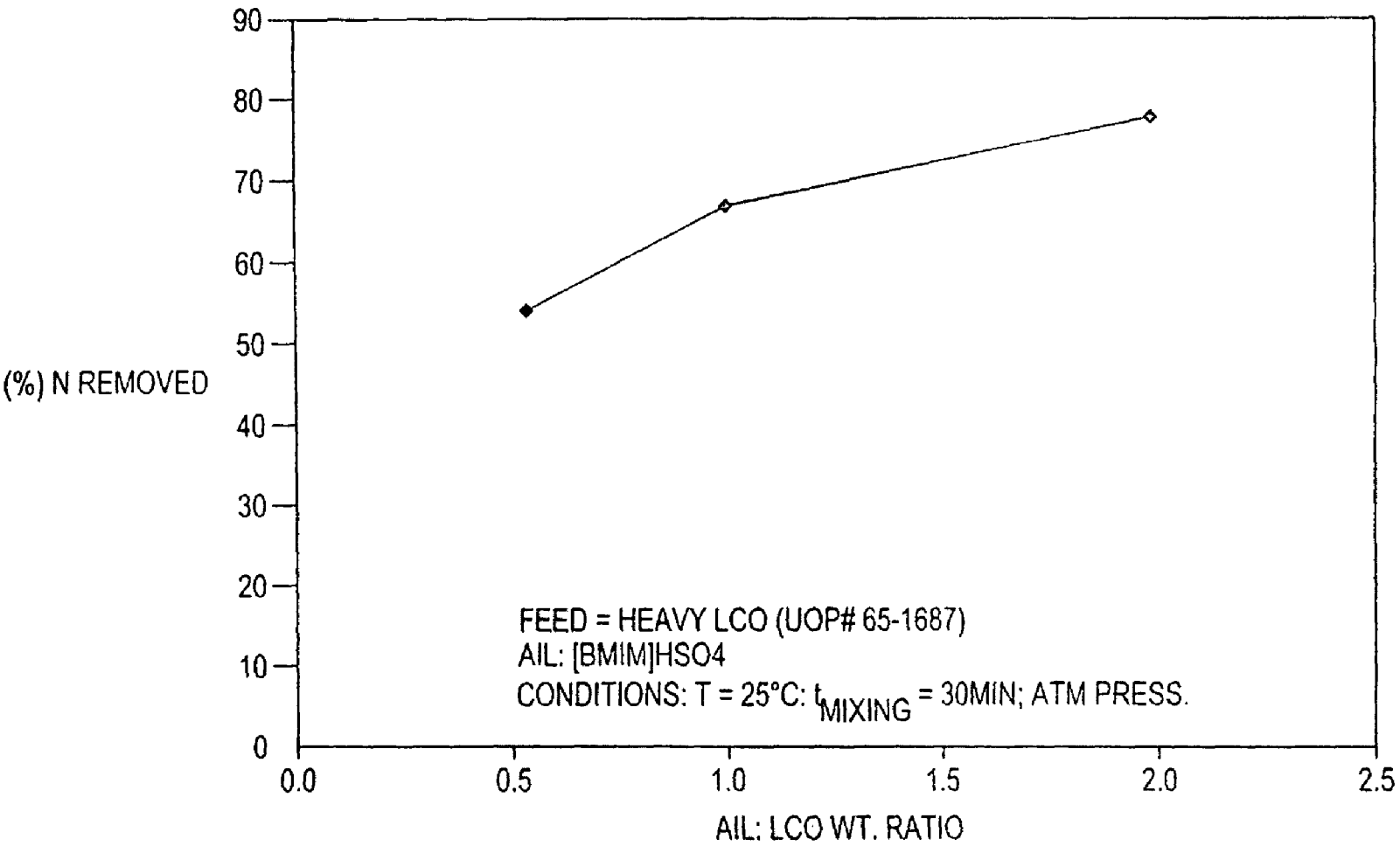
FIG. 5 is a graph of the percentage of nitrogen removed versus the AIL:LCO weight ratio.

The results in Table 7 are correlated to the graph in FIG. 5, wherein the nitrogen removal rate was significantly increased, depending on the acid ionic liquid:LCO weight ratio.

Example 6

A series of Pilot Plant runs of diesel blend versus denitrogenated diesel blend were conducted. The pilot conditions were as follows:

Feeds: Untreated (600 ppm N; 220 ppm basic N) and Denitrogenated (220 ppm N, 20 ppm basic N) Diesel Blend (SR:LCO:LCGO=1:1:1)

Desulfurization reaction conditions: P=800 psig; H2/Oil ratio=2500 SCF/B; Catalyst=KF-848

Figure 6:
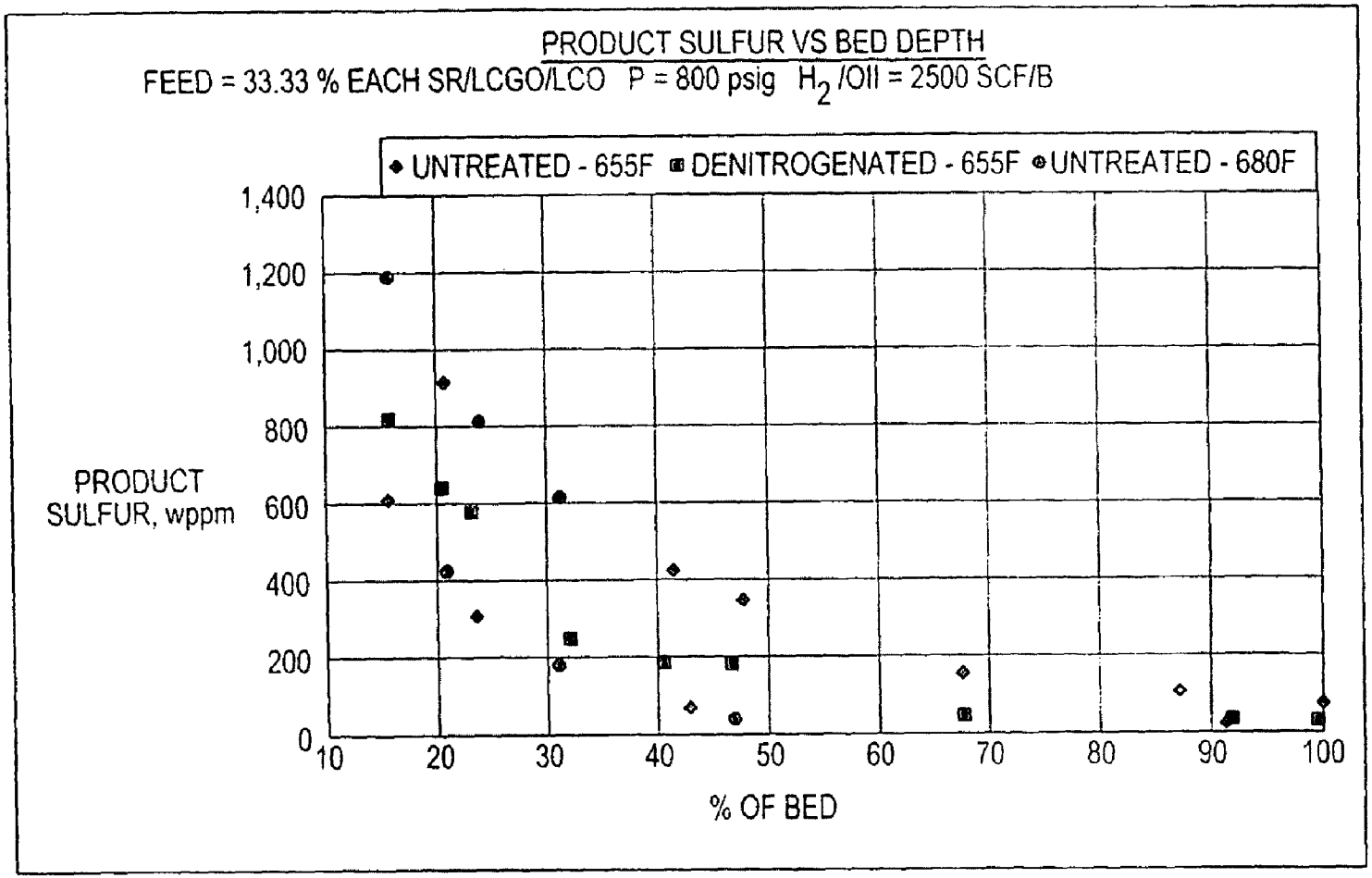
FIG. 6 is a graph of the amount of product sulfur (WPPM) versus the percentage of bed.

FIG. 6 shows the results of the pilot runs under the above conditions. It can be seen that the catalyst requirement for the denitrogenated diesel feed was only about 50% for that of the untreated feed. Also, with the denitrogenated feed, the same S conversion result can be achieved at a temperature that was about 35° F. below that required for the untreated feed.

Figure 7:
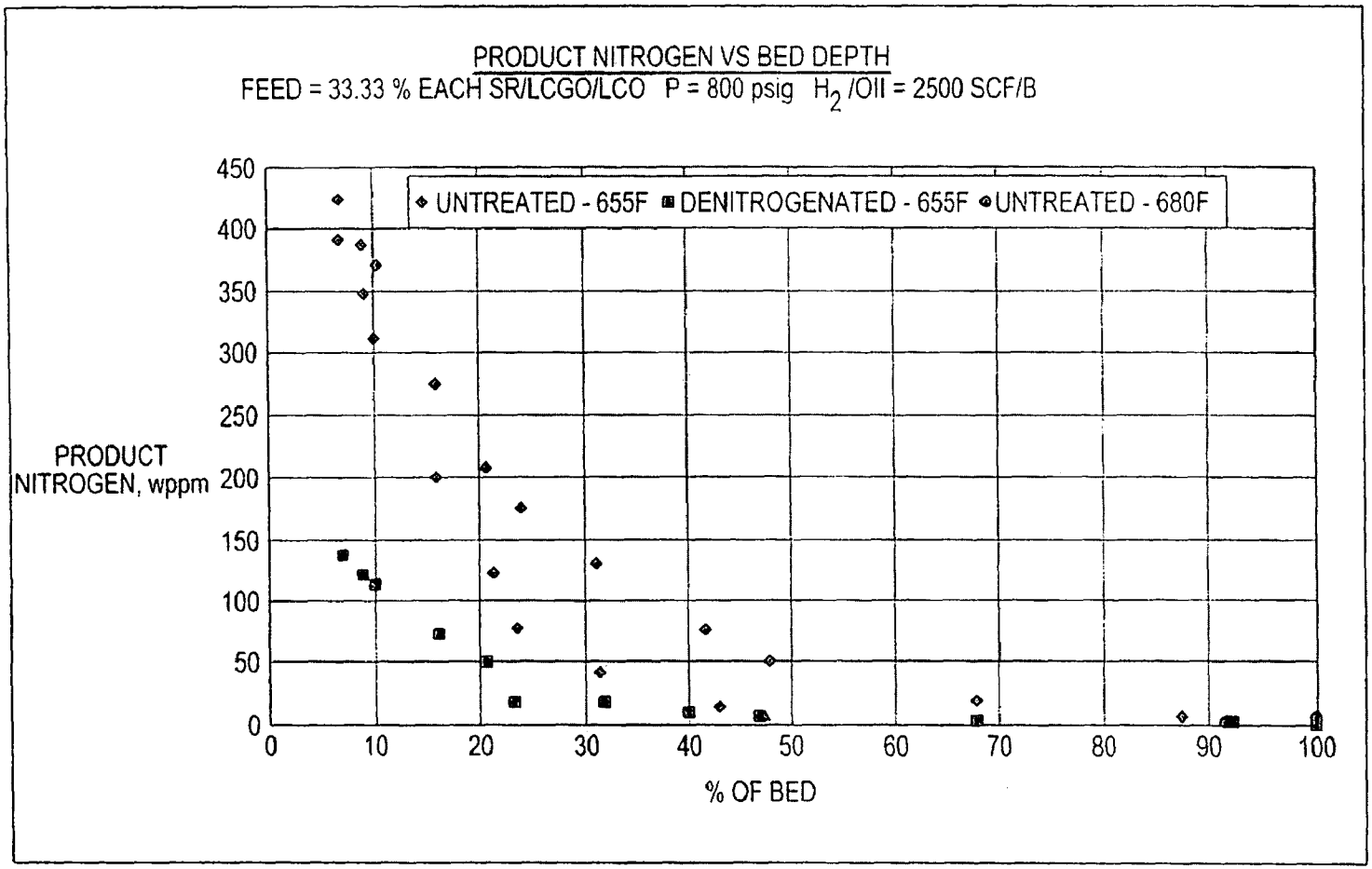
FIG. 7 is a graph of product nitrogen (WPPM) versus percentage of bed.

Referring to FIG. 7, the same series of experiments shows that treating the feed allows for about 70% of the catalyst bed to operate in a nitrogen-free environment. Thus, pilot plant runs show that it is possible to use 50% less catalyst for a treated feed versus non-treated feed for essentially the same desulfurization level. This translates into doubling the Liquid Hourly Space Velocity (LHSV), replacing the catalyst less frequently, lowering the hydrogen partial pressure, decreasing the temperature by 35° F., or various combinations of above process variables, for achieving the same S conversion level. Treating the feed allowed for 70% of the catalyst bed to operate in a N-free environment.

It can be seen from the above Examples that acid ionic liquids are highly effective in denitrogenating various types of diesel fuel. $BMIMHSO_4$, $BMIMCH_3SO_4$ and $EMIMEtSO_4$ are particularly effective. Thus, the acid ionic liquids can remove about 70% to about 95% of nitrogen from diesel fuel in one or more extraction steps. Also, the diesel fuel and acid ionic liquid weight ratios may be varied to achieve selected amounts of denitrogenation. Thus, it is possible for the diesel fuel and the acid ionic liquid to be fed into the extraction zones at a weight ratio of about 1:0.2 to about 1:2. In one aspect, the selected removal of the nitrogen species from the diesel fuel does not substantially remove meaningful/significant quantities of sulfur compounds in the diesel fuel.

A significant advantage of our denitrogenation process is that we can reduce the amount of catalyst employed in the subsequent hydrodesulfurization process. That amount of catalyst may be reduced in an amount up to about 75%, for example. Similarly, the length of time that the hydrodesulfurization catalyst can be maintained without regeneration or replacement can be increased by up to about 50% to about 100% longer than when compared to desulfurization without performing denitrogenation. Yet another advantage is the ability to increase the liquid hourly space velocity (LHSV) by up to about 50% to about 100% when compared to hydrodesulfurizing without denitrogenating. Still a further advantage is the ability to reduce the temperature in the hydrodesulfurization zone by an amount of up to about 10° C. to about 50° C. over prior methods. Finally, the hydrogen partial pressure in the desulfurization zone can be decreased by up to about 10% to about 30% when compared to hydrodesulfurizing without a denitrogenating pre-treatment. All of these advantages can be obtained while achieving substantially similar sulfur removal levels.

The denitrogenation process causes the acidic ionic liquids to contain various nitrogen species taken from the diesel feed. As a consequence, after a number of denitrogenation cycles, the acid ionic liquid has a degraded denitrogenation capacity. We have discovered that the acid ionic liquid can be regenerated by steam stripping. Steam stripping the stagnant ionic liquid phase or, more preferably, steam stripping the ionic liquid in a counter-current operation for better phase contact are two recovery approaches. Water contamination is minimized as long as the water phase is in vapor phase during the interaction with the acid ionic liquid. The steam current displaces the nitrogen species, leaving behind regenerated acid ionic liquid. We found that the $[BMIM]HSO_4$ acid ionic liquid used to denitrogenate a diesel blend with 1:0.5 diesel:AIL weight ratio was regenerated by stream stripping at 150° C. with 1 L/min steam flow rate for a total of four consecutive extraction/regeneration cycles. After the first regeneration, the acid ionic liquid lost only 2.5 and 4.5% of its extraction capacity for total nitrogen and basic nitrogen, respectively, compared to the first cycle. The performance in the 2nd, 3rd and 4th cycles was similar.

Figure 8:
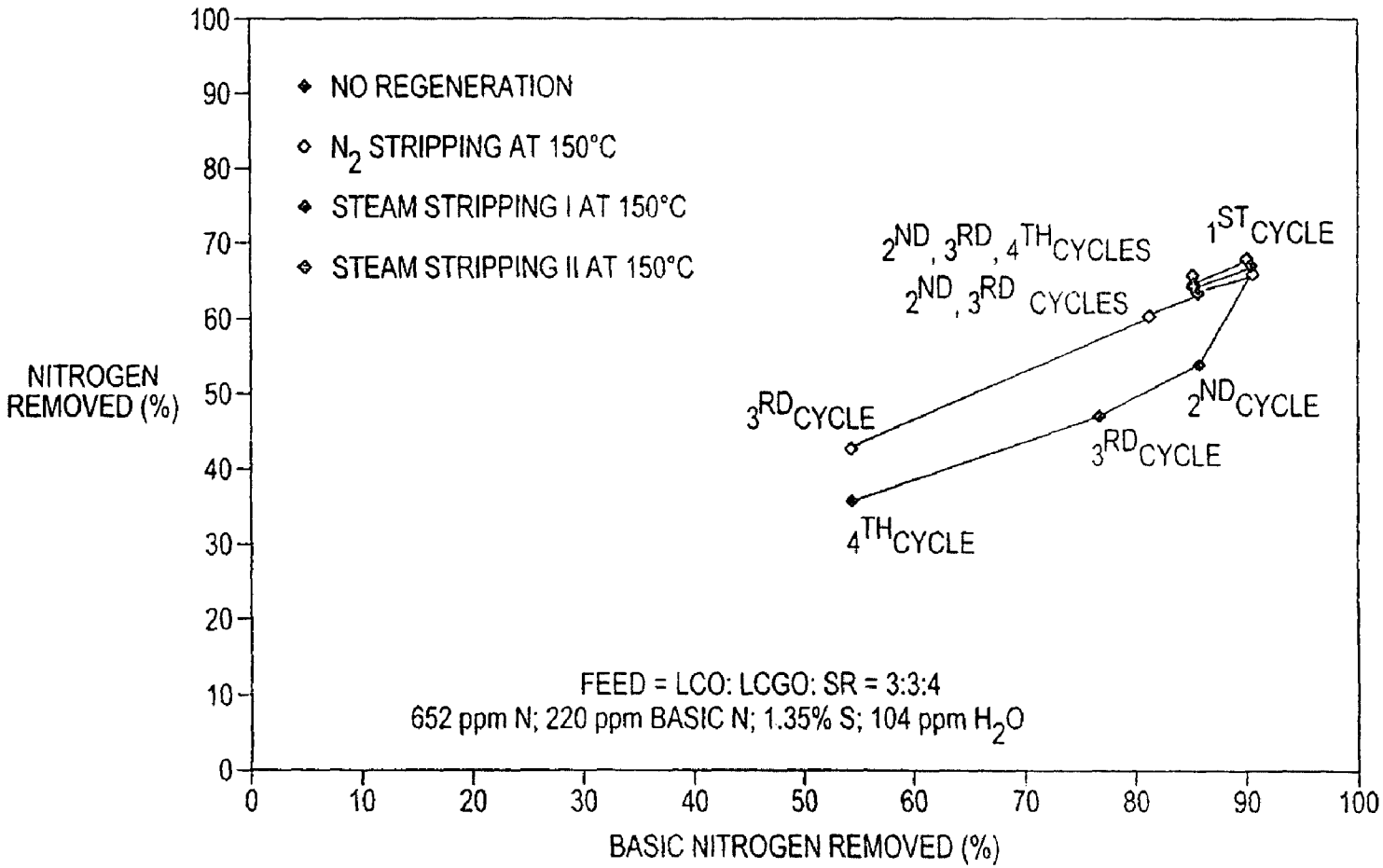
FIG. 8 is a graph of the percentage of nitrogen removed versus the percentage of basic nitrogen removed in several extraction-regeneration cycles.

Referring to FIG. 8, the results of a series of experiments are shown, wherein the percentage of nitrogen removed versus percentage of basic nitrogen removed is indicated. The experiments were conducted in a comparison to no regeneration and nitrogen stripping, versus steam stripping. The nitrogen stripping was unsuccessful and the steam stripping examples were highly favorable versus no regeneration.

What is claimed is:

1. A process for denitrogenating diesel fuel comprising:

contacting diesel fuel containing one or more nitrogen compounds with an acid ionic liquid in an extraction zone to selectively remove basic nitrogen compound(s) and produce a denitrogenated diesel fuel effluent containing denitrogenated diesel fuel and acid ionic liquid containing basic nitrogen species; and separating denitrogenated diesel fuel from the denitrogenated diesel fuel effluent.

2. The process of claim 1, wherein the extraction zone is at a temperature of about ambient temperature to about a decomposition temperature of the acid ionic liquid and at a pressure of about ambient pressure to about 1000 psi.

3. The process of claim 1, wherein the acid ionic liquid is $BMIMHSO_4$.

4. The process of claim 1, wherein the acid ionic liquid is $BMIMCH_3SO_4$.

5. The process of claim 1, wherein the acid ionic liquid is $EMIMEtSO_4$.

6. The process of claim 1, further comprising recycling at least a portion of the denitrogenated diesel fuel into the extraction zone.

7. The process of claim 1, further comprising removing substantially all of the basic nitrogen species from the acid ionic liquid containing basic nitrogen species to produce regenerated acid ionic liquid and recycling at least a portion of the regenerated acid ionic liquid into the extraction zone.

8. The process of claim 7, wherein the basic nitrogen species is separated from the acid ionic liquid containing nitrogen by steam stripping.

9. The process of claim 1, wherein at least about 70% to about 95% of nitrogen is removed from the diesel fuel.

10. The process of claim 1, wherein the denitrogenated diesel fuel effluent is fed into at least one additional extraction zone.

11. The process of claim 1, wherein the diesel fuel and the acid ionic liquid are fed into the extraction zone in a weight ratio of about 1:0.2 to about 1:0.5.

12. The process of claim 1, wherein selective removal of the nitrogen compounds does not substantially remove sulfur compounds in the diesel fuel.

13. A process for desulfurizing diesel fuel comprising:

a) contacting diesel fuel containing one or more nitrogen compounds with an acid ionic liquid in an extraction zone in a weight ratio of diesel fuel to acid ionic liquid of about 1:0.2 to about 1:0.5 to selectively remove basic nitrogen compound(s) and produce a denitrogenated diesel fuel effluent containing denitrogenated diesel fuel and acid ionic liquid containing nitrogen species;

b) separating the denitrogenated diesel fuel from the denitrogenated diesel fuel effluent; and c) desulfurizing the denitrogenated diesel fuel by hydrodesulphurization.

14. The process of claim 13, further comprising reducing the amount of catalyst by up to about 75% in the desulfurizing in step c) compared to when desulfurizing without performing steps a) and b) while achieving a similar sulfur removal level.

15. The process of claim 13, wherein said acid ionic liquid comprises $BMIMHSO_4$ or $BMIMCH_3SO_4$.

16. The process of claim 13, further comprising removing substantially all of the basic nitrogen species from the acid ionic liquid containing basic nitrogen species by steam stripping to produce regenerated acid ionic liquid and recycling at least a portion of the regenerated acid ionic liquid into the extraction zone.

17. The process of claim 13, further comprising decreasing the hydrogen partial pressure in the desulfurizing in step c) by up to about 10% to about 30% when compared to desulfurizing without performing steps a) and b) while achieving a similar sulfur removal level.

18. A process for denitrogenating diesel fuel comprising:

contacting diesel fuel containing one or more nitrogen compounds with $BMIMHSO_4$ or $BMIMCH_3SO_4$ containing 0-about 5% water in at least one extraction zone substantially at ambient temperature and ambient pressure for about 5 to about 60 minutes at a feed weight ratio of diesel fuel/$BMIMHSO_4$ or $BMIMCH_3SO_4$ of about 1:0.2 to about 1:2 to selectively remove at least about 70% of the nitrogen compound(s) and produce denitrogenated diesel fuel effluent containing denitrogenated diesel fuel and $BMIMHSO_4$or $BMIMCH_3SO_4$ containing nitrogen species and 0-5% water:

separating the denitrogenated diesel fuel from the denitrogenated diesel fuel effluent;

removing substantially all of the nitrogen species from the $BMIMHSO_4$or $BMIMCH_3SO_4$ containing nitrogen species by steam stripping to produce regenerated $BMIMHSO_4$or $BMIMCH_3SO_4$ ; and recycling at least a portion of the regenerated $BMIMHSO_4$or $BMIMCH_3SO_4$ to the extraction zone.

19. The process of claim 18, further comprising desulfurizing the denitrogenated diesel fuel by hydrodesulfurization.

* * * * *

UNITED STATES PATENT AND TRADEMARK OFFICE

CERTIFICATE OF CORRECTION

PATENT NO. : 7,749,377 B2
APPLICATION NO. : 11/985144
DATED : July 6, 2010
INVENTOR(S) : Manuela Serban et al.

It is certified that error appears in the above-identified patent and that said Letters Patent is hereby corrected as shown below:

Column 10,
Claim 13, Line 61, replace "and acid ionic liquid containing nitrogen species;"

with --and acid ionic liquid containing basic nitrogen species--.

Signed and Sealed this

Fourteenth Day of September, 2010

David J. Kappos

David J. Kappos
*Director of the United States Patent and Trademark Office*